United States Patent [19]

Benscoter

[11] Patent Number: 4,962,789

[45] Date of Patent: Oct. 16, 1990

[54] EMERGENCY WATER RESERVOIR

[76] Inventor: Kenneth Benscoter, 9254½ Walnut St., Bellflower, Calif. 90706

[21] Appl. No.: 435,699

[22] Filed: Nov. 13, 1989

[51] Int. Cl.[5] ..... E03B 11/02

[52] U.S. Cl. ..... 137/571; 137/357; 137/592

[58] Field of Search ..... 137/357, 571, 572, 575, 137/587, 592; 122/4 R; 126/344

[56] References Cited

U.S. PATENT DOCUMENTS

| | | | |
|---|---|---|---|
| 2,931,382 | 4/1960 | Cirillo | 137/375 |
| 3,095,893 | 7/1963 | Martin | 137/216 |
| 4,248,294 | 2/1981 | Budzynski et al. | 137/592 X |
| 4,313,400 | 2/1982 | Walker et al. | 122/31 R |
| 4,332,685 | 6/1982 | Nowlin et al. | 210/638 |
| 4,519,418 | 5/1985 | Fowler | 137/571 |
| 4,612,951 | 9/1986 | Desogus | 137/571 X |
| 4,700,734 | 10/1987 | McCauley | 137/571 X |
| 4,718,452 | 1/1988 | Maitland | 137/592 |
| 4,856,578 | 8/1989 | McCahill | 165/29 |

*Primary Examiner*—John Rivell

*Attorney, Agent, or Firm*—Charles H. Thomas

[57] ABSTRACT

An emergency fresh water reservoir is provided for a building for use in emergencies, such as earthquakes, floods, hurricanes and other natural disasters in which municipal water supplies are cut off or rendered impure or unpotable. The emergency water reservoir of the invention also can be used to provide a supply of water in times of man made disasters, such as war or acts of terrorism or vandalism which can render municipal water supplies suspect or unusable. The emergency water reservoir is connected between a municipal water supply line and a hot water heater for a building. Water passes through the emergency water reservoir before reaching the hot water heater. Circulation of fresh water is assured and stagnancy of water is prevented during normal operation of a municipal water supply due to flow through the emergency water reservoir to replenish water in the hot water heater, as hot water is utilized in the building. In times of emergency water can be drawn directly from the emergency water supply.

14 Claims, 1 Drawing Sheet

EMERGENCY WATER RESERVOIR

BACKGROUND OF THE INVENTION

1. Field of the Invention

The present invention relates to an emergency water reservoir and a method of maintaining an emergency supply of potable water for a building.

2. Description of the Prior Art

During situations in which there is widespread damage to municipalities, municipal water supplies are often interrupted, sometimes for prolonged periods of time. When earthquakes occur municipal water mains frequently break or develop cracks so that the populace served by such water mains is deprived of water altogether, or receives only contaminated water. The absence of an uninterrupted supply of potable water for even short periods of time can cause severe hardship and unhealthy conditions. People in urban areas are highly dependent upon a reliable municipal water supply for many basic needs. When municipal water supplies are interrupted, urban populations not only lack fresh drinking water, but they are also unable to cleanse injuries that have been incurred and they cannot even tend to basic sanitary needs.

Various emergency water supply systems have been devised to attempt to provide some water for household use in the event of a disruption of municipal water supplies. However, in conventional water tanks in which water is stored for emergency uses, there is a very considerable likelihood that water in the tanks will sit without movement for prolonged periods of time. The water thus becomes stagnant and subject to the growth of bacteria, mildew or other fungi. As a result, even though water has been stored and is available for use during emergency situations, it is impure and cannot be used for drinking or washing.

Attempts have been made to solve the problem of degradation of water with prolonged storage by treating the water with disinfectants. Tablets have been developed which, when dissolved in water, release chlorine into the water to kill mildew and bacteria. One problem with such systems is that users are often at a loss to determine the proper concentration of such water disinfectant substances. The ordinary user is not familiar enough with the proper concentrations of disinfectant materials to be applied to disinfect a quantity of water without rendering it unpotable. Excessive concentrations of disinfectant substances render the water unusable for drinking and irritating when applied to a person's skin. If the concentration of disinfectant is too weak, bacteria and fungi will still grow in the water, thereby rendering it unpotable and unsafe for external use.

Also, disinfectant must be periodically applied to the water to maintain the water safe for drinking and washing. Since the water in conventional household emergency water reservoirs is likely to remain unused for a very long period of time, it is quite likely that the necessary periodic treatments with chemical disinfectants will simply be forgotten and that an appropriate treatment schedule will not be observed.

Systems have been devised which provide emergency water reservoirs coupled in series with household plumbing fixtures. Two such systems are disclosed in U.S. Pat. Nos. 2,931,382 and 3,095,893. However, such systems would require extensive modifications to the basic plumbing system for a building, and result in an emergency water reservoir which may be inconveniently located or even inaccessible.

SUMMARY OF THE INVENTION

One object of the present invention is to provide an emergency water reservoir for a building which will be available to occupants of the building in emergencies to provide potable drinking water and water for washing and for sanitary purposes. The emergency water reservoir of the invention is located in or near the building to be served in some convenient, out of the way storage area, but in a location which will be accessible during an emergency. The water reservoir may be located, for example, in a garage, a basement, or even outside of a building as long as it is not subjected to subfreezing temperatures.

A further object of the invention is to provide an emergency water reservoir which will provide an emergency water supply for domestic use which does not require the use of disinfectants or other chemical treatments. The volume of the emergency water reservoir should be of a size suitable to accommodate the emergency need for water by the occupants of the building to be served. The emergency water reservoir may be any size and indeed can be formed in any shape. The reservoir may be formed of a single, relatively large storage compartment or by a plurality of smaller compartments serially connected together.

A further object of the invention is to provide an emergency water reservoir for a building which is not subject to water stagnation and which is not subject to the growth of bacteria and fungi which occur within a volume of water that is stored for a prolonged period of time.

Yet a further object of the invention is to provide an emergency water reservoir through which water is circulated to prevent stagnation and which does not involve any waste of water or any pumps to effectuate the necessary water circulation.

A further, very important object of the invention is to provide an emergency water reservoir which can be coupled to the existing plumbing system for a building without the necessity for extensive modifications to the basic plumbing system for the building. This is achieved by connecting the emergency water reservoir in line between a local conventional water supply and a standard hot water heater which is installed in virtually all buildings in industrialized countries. The installation of the reservoir takes advantage of existing plumbing fittings and connection locations which are nearly universally available to accommodate existing domestic, commercial and industrial hot water heaters that are used on a daily basis to meet the requirements for hot water within a building.

Yet another object of the invention is to provide a means for supplying disaster victims in a building with water for drinking, washing and cooking, and for sanitary purposes when municipal water supplies are disrupted or become contaminated. Municipal water disruption or water contamination frequently occurs during widespread disasters, such as earthquakes, hurricanes and flooding.

In one broad aspect the present invention may be considered to be an emergency water reservoir comprising a hollow enclosed tank having a water inlet coupled to receive water from a water supply system, a water outlet coupled to a hot water heater inlet, and a water tap for withdrawing water for use directly from the tank. The water supply system for a building is likely to be a municipal water supply system, although the invention is equally applicable to buildings supplied by water from a well, as earthquakes and other disasters adversely affect local well water supplies as well as municipal water supplies.

By locating the enclosed emergency water storage tank of the invention between the municipal water line or other water source for the building and the conventional hot water heater found in virtually all buildings in industrialized countries, circulation of water through the storage tank is achieved without any waste whatsoever. As hot water is consumed for normal use within the building, water in the hot water heater is replenished from the emergency water storage tank of the invention. The water in the emergency water storage tank, in turn, is replenished from the municipal water supply system which serves the building. Thus, the rate of water circulation through the emergency water storage tank which is achieved is equal to the rate of utilization of hot water within the building.

Furthermore, by interposing the emergency water tank between the water supply and a conventional hot water heater, no modifications to the existing plumbing whatsoever are required. The emergency tank is coupled to the conventional plumbing termination provided for a hot water heater, which is normally located in or closely adjacent to an area within the building large enough to accommodate the emergency storage tank of the invention. Also, installation does not require soldering or welding of any existing plumbing lines, but to the contrary utilizes existing plumbing terminations and fittings.

It is unnecessary for the enclosed emergency water reservoir tank of the invention to be heated, since water drawn from that tank to replenish water in the hot water heater is heated in the hot water heater by the heating unit associated therewith. Thus, there is no additional consumption of fuel to heat water passing through the emergency reservoir beyond that normally consumed to meet the hot water needs of the occupants of a building.

In another broad aspect the invention may be considered to be an improvement in a water supply system for a building which is connected to receive water from a municipal water supply and in which a hot water heater is coupled to receive water from the municipal water supply. The improvement of the invention is comprised of an emergency water reservoir formed by an enclosed tank having a water tap therein for drawing water directly therefrom. The tank is interposed in line between the municipal water supply and the hot water heater. Water flows from the municipal water supply through the tank to the hot water heater as long as the municipal water supply remains uninterrupted and uncontaminated. In the event of a disruption to the municipal water supply, however, water is available directly from the emergency water reservoir tank.

In another aspect the invention may also be considered to be a method of maintaining an emergency supply of fresh water for a building. According to the method an enclosed water tank having a water tap is interposed in a water circulation line that extends between a municipal water supply and a hot water heater for a building, and water is withdrawn directly from the water tank through the water tap when water is unavailable from the municipal water supply.

Preferably, the water tap on the emergency water reservoir tank is comprised of a conventional hose bib with a manually operable valve. The conventional externally threaded hose bib allows a conventional garden hose to be connected to the water tap on the emergency water reservoir tank. The nozzle of the garden hose can be moved to a location which is most convenient to the building occupants to be served.

The emergency water reservoir system of the invention is applicable to any type of building which is equipped with a conventional hot water heater. The invention may be utilized in dwellings such as single family residences and apartment buildings, but is equally applicable to commercial and industrial buildings such as office buildings and factories, as well. The emergency water reservoir can be located at any convenient location within the building where space is available, or it can be located outside of the building. The reservoir may either be insulated or uninsulated. There is no requirement for heating of the reservoir, although it must be kept from freezing to avoid damage to the emergency storage tank.

The emergency water tank of the invention may be constructed of stainless steel, coated carbon steel, fiberglass, plastic or any other approved drinking water container material. The structural specifications of the reservoir tank should conform to applicable building and municipal codes.

The emergency water reservoir tank has a bottom and a top, and the water inlet and the water tap of the tank are preferably located at the bottom thereof. The inlet is connected to the municipal water supply and is normally equipped with a manually operated shut off valve which can be operated to prevent water from entering the tank should the municipal water supply become contaminated. The inlet may also be provided with a check valve to prevent water from draining out of the inlet to the emergency water reservoir tank in the event the water supply inlet to the tank from the municipal water main is broken during a disaster situation.

The outlet of the emergency water reservoir tank is preferably located at the top of the tank so that water rising from the inlet at the bottom will force it out of the outlet through the top of the tank to thereby maximize the quantity of water stored in the tank. The inlet and outlet of the tank are both preferably equipped with conventional plumbing union joints to allow the emergency water storage tank to be inserted at any location in a water line between the municipal water supply and a conventional water heater at which a threaded termination is located.

Preferably also the top of the tank is equipped with a safety pressure relief valve in addition to the water outlet to allow the escape of any air or steam entrapped within the emergency water reservoir. This feature can prevent the emergency water tank from exploding with lethal effects should a fire occur in the building in the vicinity of the tank with enough intensity to cause water to boil within the tank.

The invention may be described with greater clarity and particularity with reference to the accompanying drawings.

DESCRIPTION OF THE EMBODIMENTS

Figure 1:
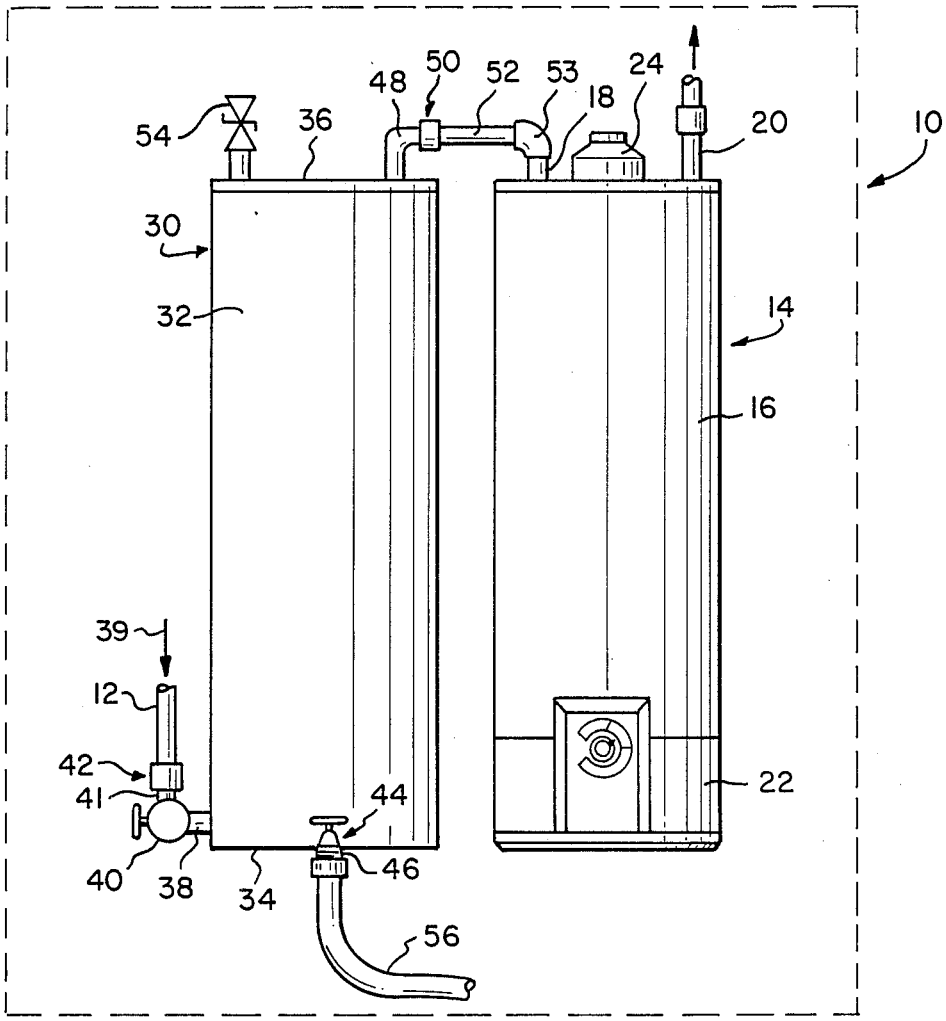
FIG. 1 is a side elevational view showing one embodiment of the emergency water reservoir of the invention as installed in a water supply system for a building.

FIG. 1 illustrates a water supply system for a building indicated generally at 10. The water supply system is connected to receive water from a municipal water main through a municipal water supply line 12. A conventional residential or commercial hot water heater 14 is located in or near the building 10 and is coupled to receive water from the municipal water supply line 12. The conventional hot water heater 14 is of the normal size suitable for accommodating the needs of the building 10, and typically has a capacity of between 30 and 100 gallons of water. The conventional hot water heater 14 includes an upright generally cylindrical hot water storage tank 16, a water inlet connection 18, a water outlet connection 20, a burner unit 22 and an exhaust gas vent 24.

The improvement of the invention resides in the interposition of an emergency water reservoir 30 between the municipal water supply line 12 and the domestic hot water heater 14. The emergency water reservoir 30 is formed with an enclosed hollow stainless steel or fiberglass tank 32. In the embodiment of FIG. 1 the hollow tank 32 is configured with cylindrical walls and supported in an upright disposition, preferably in physical proximity to the hot water heater 14.

The cylindrical tank 32 is equipped with a disk shaped floor 34 at the bottom thereof and a disk shaped top 36 at the top thereof. The enclosed tank 32 is equipped with a water inlet pipe 38 to which a manual shut off valve 40 is connected. The shut off valve 40 may also be equipped with a check valve to allow water flow in from the municipal water supply line 12, as indicated by the directional arrow 39, but to prevent flow in the opposite direction. A water inlet nipple 41 which is also connected to the valve 40, terminates at a conventional plumbing union coupling 42, which is also joined to the externally threaded tip of the municipal water supply line 12. Also at the bottom of the enclosed tank 32 there is a water tap 44, which preferably is comprised of a hose bib 46 and an externally threaded nipple fitting that is transversely directed and engaged in a tapped opening in the cylindrical wall of the tank 32. The hose bib 46 terminates in a conventional downwardly facing externally threaded mouth.

At the top of the emergency water storage reservoir tank 32 there is a water outlet pipe 48 that, like the inlet pipe 38, leads to a union coupling 50. A connecting pipe 52 leads from the union coupling 50 to the inlet line 18 of the hot water heater 14 through a conventional plumbing elbow 53. A safety pressure relief valve 54 is preferably located at the top of the enclosed tank 32. The enclosed tank 32 has upright cylindrical walls with a disk shaped floor at the bottom thereof and a disk shaped roof at its top. The water inlet pipe 38 is located at the floor 34 and the water outlet 48 is located in the roof 36.

During normal operation of the municipal water supply, water enters the building 10 from a municipal water main through the municipal water supply line 12 and enters the emergency water reservoir 30 through the inlet pipe 38 at the bottom 34 thereof. Water fills the emergency water reservoir tank 32 all the way to the top, and overflows through the outlet 48 into the pipe 52 and then into the inlet 18 of the hot water heater 14.

During normal operation of the system the water within the tank 16 of the hot water heater 14 is heated by the burner unit 32, which is typically a natural gas burner heating unit. Fumes from the burner 22 travel upwardly through a central exhaust pipe and leave the hot water heater 14 through an exhaust duct 24, which typically is connected to a chimney exhaust.

The normal, everyday domestic needs for hot water will involve the turning on of hot water taps throughout the building 10 from time to time, so that hot water is drawn from the hot water heater 14 through the outlet line 20 thereof. As hot water is drawn through the outlet line 20, it is replenished with cold water which enters the hot water heater 14 through the inlet 18 thereof. The replenishing water is received from the emergency water reservoir tank 32, which in turn is replenished from the municipal water supply line 12, which provides municipal water to the emergency water reservoir 30 through the water inlet line 38 to the reservoir tank 32. Thus, the water within the emergency storage tank 32 will not stagnate, as it circulates through the tank 32 and is replenished as water is withdrawn through the hot water heater outlet line 20.

In the event of an emergency condition, such as a major earthquake, the municipal water supply may be disrupted and cease to flow into the emergency water reservoir 30 through the municipal water supply line 12. Under such conditions water is available from the emergency water reservoir 30 through the water tap 44 thereof. A user need only open the manual operating valve on the tap 44 to allow water to flow therefrom into a bucket or other receptacle. For the convenience of the users, a conventional garden hose, indicated at 56, may be coupled to the hose bib 46 to carry water drawn from the emergency water reservoir 30 to a more convenient location within a building 10.

Should the emergency condition not totally disrupt the municipal water supply, but rather result in contamination of the municipal water supply, the manually operated valve 40 should be operated so as to isolate the emergency water reservoir 30 which contains uncontaminated water that would have been collected prior to the natural disaster. Contaminated water is thereby prevented from flowing from the municipal water supply line 12 into the emergency water reservoir inlet pipe 38. Water can then be withdrawn safely from the emergency reservoir 30 through the water tap 44 at the lower portion of the water tank 32 in the manner previously described.

Figure 2:
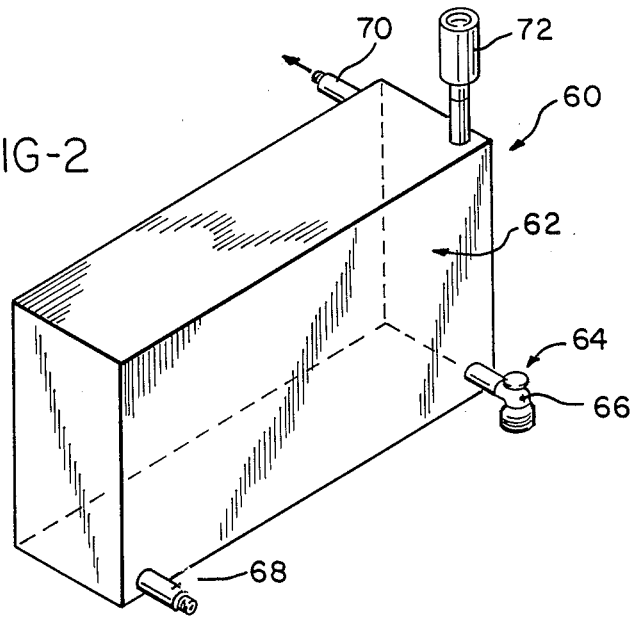
FIG. 2 is a perspective view illustrating an alternative embodiment of an emergency water reservoir tank according to the invention.

FIG. 2 illustrates an alternative embodiment of an emergency water reservoir tank 60. The emergency water reservoir tank 60 may be configured in the shape of a rectangular prism, as illustrated. As in the embodiment of FIG. 1, the emergency water reservoir tank 60 is equipped with a water tap 64 terminating in a hose bib 66 and an inlet pipe 68 adapted for coupling to the municipal water supply line 12. An outlet 70 is provided at the upper portion of the tank 62 and is adapted for coupling in line to the inlet of a conventional hot water heater. A safety pressure relief valve 72 may be located at the top of the tank 62.

It is to be understood that numerous variations and modifications of the emergency water reservoir system of the invention are possible. For example, the emergency water reservoir tank may be formed in any suitable shape adapted to fit into an available storage space, and may be divided into discrete, serially connected compartments located at different storage locations throughout the building. Also, any suitable inlet and outlet connectors and construction materials may be employed in the fabrication of the emergency water tap and the water tank inlets and outlets, as well as in the fabrication of the emergency water reservoir tank itself. Accordingly, the scope of the invention should not be construed as limited to the specific embodiments and implementations depicted and described herein, but rather is defined in the claims appended hereto.

I claim:

1. An emergency water reservoir comprising a hollow enclosed tank constructed entirely of non-toxic materials having a water inlet coupled to receive water directly from a hot water heater plumbing termination of a water supply system for a building, a water outlet coupled directly to a hot water heater inlet, and a water tap for withdrawing water for use directly from said tank.

2. An emergency water reservoir according to claim 1 further characterized in that said enclosed tank has a bottom and a top, and said water inlet and said water tap thereof are located at said bottom of said tank and said outlet thereof is located at said top of said tank.

3. An emergency water reservoir according to claim 2 further characterized in that said water tap is comprised of a hose bib having a manually operable valve.

4. An emergency water reservoir according to claim 3 further characterized in that said top of said tank is equipped with a pressure relief valve.

5. An emergency water reservoir according to claim 3 wherein said hollow tank has cylindrical walls with a disk shaped floor at the bottom thereof and a disk shaped roof at the top thereof, and said water inlet thereof is located at said floor and said water outlet thereof is located in said roof.

6. An emergency water reservoir according to claim 3 wherein said hollow tank is configured in the shape of a rectangular prism.

7. In a water supply system for a building which is connected to receive water from a municipal water supply and including an existing hot water heater plumbing termination for said building and in which a hot water heater is coupled to receive water from said municipal water supply, the improvement comprising an emergency water reservoir formed by an enclosed tank constructed entirely of non-toxic materials that contain and maintain drinking water in a potable condition, said tank having a water tap therein for drawing water directly therefrom, wherein said tank is connected directly to said hot water heater plumbing termination and is interposed in line between said hot water heater plumbing termination from said municipal water supply and said hot water heater, and is connected directly to said hot water heater, whereby water flows from said municipal water supply to said hot water heater plumbing termination and through said tank directly to said hot water heater.

8. An improved water supply system according to claim 7 in which said emergency water reservoir has a lower portion and an upper portion and wherein said water tap is located in said lower portion.

9. An improved water supply system according to claim 8 wherein said emergency water reservoir has an inlet in said lower portion coupled to said municipal water supply and an outlet in said upper portion coupled to said hot water heater.

10. An improved water supply system according to claim 9 further comprising a check valve located in said inlet to allow flow through said inlet into said emergency water reservoir and to prevent flow through said inlet in the opposite direction.

11. An improved water supply system according to claim 8 wherein said water tap is comprised of a hose bib with a manually operable valve.

12. An improved water supply system according to claim 8 further comprising a pressure relief valve in said upper portion of said emergency water reservoir.

13. A method of maintaining an emergency supply of fresh water for a building comprising:

fabricating an enclosed water tank entirely of non-toxic materials, interposing an enclosed water tank having a water tap in a water circulation line that extends between a municipal water supply system and a hot water heater for said building by connecting said enclosed water tank directly to an existing hot water heater plumbing termination provided to supply water to said hot water heater and by also connecting said enclosed water tank directly to said hot water heater, containing and maintaining water in said enclosed tank in a potable condition suitable for drinking water, and withdrawing water directly from said water tank through said water tap when potable water is unavailable from said municipal water supply system.

14. A method according to claim 12 further comprising connecting a hose to said water tap.

* * * * *